US011603614B2

(12) United States Patent
Frey et al.

(10) Patent No.: US 11,603,614 B2
(45) Date of Patent: Mar. 14, 2023

(54) APPARATUS FOR MAKING SPUNBOND

(71) Applicants: Detlef Frey, Niederkassel (DE); Martin Neuenhofer, Roesrath (DE); Sebastian Sommer, Troisdorf (DE)

(72) Inventors: Detlef Frey, Niederkassel (DE); Martin Neuenhofer, Roesrath (DE); Sebastian Sommer, Troisdorf (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 122 days.

(21) Appl. No.: 17/154,198

(22) Filed: Jan. 21, 2021

(65) Prior Publication Data

US 2021/0172104 A1 Jun. 10, 2021

Related U.S. Application Data

(63) Continuation-in-part of application No. 15/939,753, filed on Mar. 29, 2018, now abandoned.

(30) Foreign Application Priority Data

Mar. 31, 2017 (EP) ..... 17164375

(51) Int. Cl.

| | |
|---|---|
| ***D04H 3/16*** | (2006.01) |
| ***D01D 5/088*** | (2006.01) |
| ***D01D 5/098*** | (2006.01) |

(52) U.S. Cl.

CPC ..... *D04H 3/16* (2013.01); *D01D 5/088* (2013.01); *D01D 5/098* (2013.01)

(58) Field of Classification Search

CPC ..... D01D 4/02; D01D 5/088; D01D 5/092; D01D 5/098; D01D 5/0985; D04H 3/005; D04H 3/02; D04H 3/16

See application file for complete search history.

(56) References Cited

U.S. PATENT DOCUMENTS

| | | | | |
|---|---|---|---|---|
| 5,460,500 | A * | 10/1995 | Geus | D04H 3/02 264/210.8 |
| 2010/0062672 | A1* | 3/2010 | Fare' | D04H 3/16 264/103 |
| 2013/0099409 | A1* | 4/2013 | Schutt | D01D 5/0985 425/83.1 |

* cited by examiner

*Primary Examiner* — Xiao S Zhao
*Assistant Examiner* — Joseph S Leyson
(74) *Attorney, Agent, or Firm* — Andrew Wilford

(57) ABSTRACT

An apparatus for making spunbond from continuous thermoplastic filaments has a spinneret for spinning the continuous filaments and advancing them in a filament-travel direction, a cooler for cooling the filaments, a stretcher for stretching the filaments, a depositing device including a foraminous belt extending in a machine direction transverse to the filament-travel direction for deposition of the filaments as a nonwoven web and conveyance away from the stretcher, a diffusor between the stretcher and the foraminous belt so that filaments and primary air from the stretcher enter into the diffusor, and a suction device for extracting air through the foraminous belt at an unobstructed extraction region underneath the diffusor outlet and having a width b in a machine direction that is greater than a width B of the diffusor outlet. The diffusor forms upstream and downstream secondary air-inlet gaps at opposite ends through which secondary air is aspirated into the diffusor.

8 Claims, 2 Drawing Sheets

APPARATUS FOR MAKING SPUNBOND

CROSS REFERENCE TO RELATED APPLICATIONS

This application is a continuation-in-part of U.S. patent application Ser. No. 15/939,753 filed 29 Mar. 2018 with a claim to the priority of European patent application 17164375.2 filed 31 Mar. 2017.

FIELD OF THE INVENTION

The present invention relates to the manufacture of spunbond. More particularly this invention concerns an apparatus for making spunbond from continuous filaments.

BACKGROUND OF THE INVENTION

An apparatus for making spunbond from endless filaments, in particular continuous filaments of thermoplastic material, has at least one spinneret for spinning the continuous filaments, at least one cooler for cooling the filaments, at least one stretcher for stretching the filaments and at least one device for depositing the filaments to form the desired nonwoven web. A continuous or endless filaments means within the scope of the invention filaments having almost continuous length. These continuous filaments differ in this respect from staple fibers which have much shorter lengths of for example 10 mm to 60 mm.

An apparatus of the above-mentioned type is basically known from practice in various embodiments. Such an apparatus is also known as a spunbond apparatus. Many of the apparatuses of this type known from practice have the disadvantage that at high filament speeds and high throughputs or production rates, the quality of the filament deposition leaves something to be desired. This particularly relates to the homogeneity of the deposition and the strength of the nonwoven webs produced. High filament speeds and low titers of product continuous filaments can frequently only be achieved with significant loss of quality of the nonwoven webs produced. The known apparatuses are therefore capable of improvement in this respect.

OBJECTS OF THE INVENTION

It is therefore an object of the present invention to provide an improved apparatus for making spunbond of continuous filaments.

Another object is the provision of such an improved apparatus for making spunbond of continuous filaments that overcomes the above-given disadvantages, in particular in which high filament speeds and low titers as well as high production rates can be achieved and the quality of the filament deposition or the nonwoven web produced meets all requirements despite the high production rate.

SUMMARY OF THE INVENTION

An apparatus for making spunbond from continuous thermoplastic filaments has according to the invention a spinneret for spinning the continuous filaments and advancing them in a filament-travel direction, a cooler for cooling the filaments, a stretcher for stretching the filaments, a depositing device including a foraminous belt extending in a machine direction transverse to the filament-travel direction for deposition of the filaments as a nonwoven web and conveyance away from the stretcher, a diffusor between the stretcher and the foraminous belt so that filaments and primary air from the stretcher enter into the diffusor, and a suction device for extracting air through the foraminous belt at an unobstructed extraction region underneath the diffusor outlet that is free of further structures between the partitions and has a width b in a machine direction that is greater than a width B of the diffusor outlet. The diffusor forms upstream and downstream secondary air-inlet gaps at opposite ends through which secondary air is aspirated into the diffusor. The secondary air-inlet gaps are oriented such that the secondary air flows in at an inflow angle $\alpha$ of less than 100° with respect to the filament-travel direction or with respect to a longitudinal central plane of the depositing device or of the diffusor. The diffuser has walls forming a downstream section diverging toward the depositing device and forming the outlet.

In other words, the invention is an apparatus for making spunbond from continuous filaments, in particular from thermoplastic material, comprising at least one spinneret for spinning the continuous filaments, at least one cooler for cooling the filaments, at least one stretcher for stretching the filaments and comprising at least one depositing device, in particular in the form of a depositing foraminous belt, for depositing the filaments to form the nonwoven web. At least one diffusor is provided between the stretcher and the depositing device or the depositing foraminous belt so that filaments and primary air from the stretcher enter into the diffusor, and in the region of the at least one diffusor at least two secondary air-inlet gaps provided on opposite ends of the diffusor are provided through which the secondary air enters into the diffusor. In addition the at least two secondary air-inlet gaps are formed such that the secondary air flows in at an inflow angle $\alpha$ with respect to the filament-travel direction or with respect to the longitudinal central plane M of the apparatus or the diffusor, this inflow angle $\alpha$ being less than 100°, advantageously less than or equal to 90°, preferably less than 80°, preferably less than 70° and particularly preferably less than 65°. The downstream diffusor section in the filament-travel direction has diffusor walls that diverge toward the depositing device, and these diffusor walls form a diffusor outlet having a width B relative to the machine direction MD. Finally a suction device extracts ambient or process air through the depositing device or through the depositing foraminous belt and forms an unobstructed extraction region provided underneath the diffusor outlet that has a width b in the machine direction greater than the width B of the diffusor outlet. "Machine direction" (MD) means within the scope of the invention in particular the conveying direction of the filament deposition or nonwoven web on the deposition device or on the depositing foraminous belt.

It lies within the scope of the invention that the unobstructed extraction region with its width b extends underneath the diffusor over the entire width B of the diffusor outlet. It also lies within the scope of the invention that the unobstructed extraction region is delimited by two partitions provided one after the other in the machine direction. The width b of the unobstructed extraction region is in particular measured between the upper or upstream edges juxtaposed with the foraminous belt in the machine direction. Advantageously the suction means includes an extraction fan that extracts process air in the unobstructed extraction region through the deposition device or through the depositing foraminous belt. According to one embodiment of the invention, several unobstructed extraction regions can be provided consecutively in the machine direction, for example three unobstructed extraction regions, which in particular differ from one another relative to their extraction speeds. The unobstructed extraction region is the principal unobstructed extraction region provided underneath the diffusor output or directly underneath the diffusor outlet. In principle, the unobstructed extraction region or principal unobstructed extraction region provided under the diffusor outlet or directly under the diffusor outlet can for its part be divided for example by partitions. This unobstructed extraction region or principal unobstructed extraction region is then characterized in that the extraction speed is the same or substantially the same over the entire width b of the unobstructed extraction region. Advantageously the average extraction speed in the unobstructed extraction region or principal unobstructed extraction region varies by no more than 20%, in particular no more than 30% or no more than 40% and in particular by no more than 50%. It lies within the scope of the invention in this connection that in an additional unobstructed extraction region upstream of the principal unobstructed extraction region relative to the machine direction (MD) according to one embodiment and/or another additional unobstructed extraction region provided downstream of the unobstructed extraction region or principal unobstructed extraction region relative to the machine direction (MD), an extraction speed exists that is different from the extraction speed of the unobstructed extraction region or the principal unobstructed extraction region.

According to a particularly recommended embodiment of the invention, the width b of the unobstructed extraction region is at least 1.2 times, preferably at least 1.3 times and particularly preferably at least 1.4 times the width B of the diffusor outlet. According to one embodiment, the width b of the unobstructed extraction region is at least 1.5 times, in particular at least 1.6 times or at least 1.7 times the width B of the diffusor outlet.

A very preferred embodiment of the apparatus according to the invention is characterized in that the unobstructed extraction region projects relative to the machine direction (MD) downstream of the deposition region of the filaments by a first extraction section beyond the width (measured in the machine direction) of the diffusor outlet and/or that the unobstructed extraction region projects relative to the machine direction (MD) upstream of the deposition region of the filaments by a second extraction section beyond the width of the diffusor outlet. Preferably the unobstructed extraction region or the principal unobstructed extraction region projects on both sides relative to its width b beyond the width B of the diffusor outlet and specifically on one side by the first extraction section and on the other side by the second extraction section. Advantageously the width $b_1$ of the first extraction section and/or the width $b_2$ of the second extraction section is 2 to 30%, preferably 2.5 to 25% and particularly preferably 3 to 20% of the width B of the diffusor outlet.

A very recommended embodiment of the invention is characterized in that extraction by the suction device takes place such that at least in the region of the diffusor outlet, tertiary ambient air flows along the outer surfaces of the diffusor walls toward the depositing device or depositing foraminous belt and that at least a part of this tertiary air is extracted through the deposition device or the depositing foraminous belt. It lies within the scope of the invention that the tertiary air flows are preferably aligned parallel or substantially parallel to the mixed flow of primary air and secondary air flowing toward the diffusor outlet inside the diffusor. It is recommended that the volume flow of tertiary air VT drawn through the belt by the suction device is at least 25%, preferably at least 30%, preferably at least 40% and particularly preferably at least 50% of the volume flow of extracted primary and secondary air flows. The previously described preferred extraction of the tertiary air has proved successful insofar as undesired turbulence in the deposition region of the filaments can thereby be avoided.

According to the invention, the continuous filaments are produced using a spunbond apparatus. It lies within the scope of the invention here that the cooler, the stretcher and the at least one diffusor extend transversely to the machine direction (MD), which itself is horizontal and normally transverse to the filament-travel direction, over the production width or over the width (DC width) of the nonwoven web to be produced. According to a particularly preferred embodiment of the invention, the subassembly comprising the cooler and the stretcher is a closed subassembly and apart from the supply of cooling air in the cooler, no further supply of a fluid medium or no further supply of air into this closed subassembly of cooler and stretcher takes place. This closed subassembly or this closed system has proved particularly successful within the framework of the invention and contributes effectively to attaining the object of the invention.

The cooler of the apparatus according to the invention can have only one cooling chamber in which the filaments are acted upon with cooling air or process air at a specific temperature. According to a further embodiment of the invention, the cooler has upstream and downstream cooling chambers provided one above the other or consecutively in the downward filament-travel direction. In these cooling chambers the filaments can each be acted upon with cooling air or process air at different temperatures. The apparatus can also be adapted such that the exit speed of the process air from the upstream cooling chamber for cooling the filaments and the exit speed from the lower downstream cooling chamber is different.

The secondary air-inlet gaps or the secondary air introduced through these secondary air-inlet gaps have particular importance within the framework of the invention. In this case, it lies within the scope of the invention that the secondary air-inlet gaps extend over the entire width of the apparatus transversely to the machine direction (in the CD direction). According to a very preferred embodiment of the invention, two opposite secondary air-inlet gaps are provided between the stretcher and the diffusor adjacent the stretcher. According to one embodiment of the invention, two diffusors are provided consecutively in the filament-travel direction and two opposite secondary air-inlet gaps are provided between the two diffusors. Two secondary air-inlet gaps can be at the same vertical height. However it also lies within the scope of the invention that the secondary air-inlet gaps are provided at different vertical heights of the apparatus. According to a preferred embodiment of the invention only two opposite secondary air-inlet gaps are provided and particularly preferably between stretcher and diffusor.

Of particular importance is the inflow angle $\alpha$ of the secondary air. According to the invention, at least one secondary air-inlet gap and preferably at least two secondary air-inlet gaps, particularly preferably two secondary air-inlet gaps are formed such that the secondary air flows in at an inflow angle $\alpha$ with respect to the filament-travel direction. According to one embodiment, the inflow angle $\alpha$ is between 80° and 110°. A recommended embodiment is characterized in that the inflow angle $\alpha$ is less than 90°, preferably less than 80°, preferably less than 70° and particularly preferably less than 65°. In this case, it has proved particularly successful when the inflow angle $\alpha$ is less than 60°, preferably less than 55° and very preferably less than 50°. According to a very recommended embodiment, the inflow angle α is between 0 and 60°, advantageously between 1 and 55°, preferably between 2 and 50°, very preferably between 2 and 45° and particularly preferably between 2 and 40°. It is particularly recommended that the inflow of secondary air takes place such that after its entry the secondary air flows parallel or quasi-parallel to the filament-travel direction.

Advantageously the secondary air-inlet gaps are adapted accordingly to achieve the inflow angle α, in particular adapted with the aid of inflow slopes and/or inflow passages and the like. According to a preferred embodiment, in order to implement the inflow angle α in the region of a secondary air-inlet gap, a sloping inflow wall adjacent or connected to a diffusor wall of the diffusor is provided, which inflow wall encloses an angle with the filament-travel direction that corresponds or substantially corresponds to the inflow angle α. Preferably in this embodiment, a corresponding inflow wall is provided for each secondary air-inlet gap. It is recommended that such an inflow wall forms an inflow slope to implement the inflow angle α. The implementation of the inflow angle α according to the invention has proved particularly successful within the scope of the invention and makes an efficient contribution to the solution of the technical problem. Combined with the configuration of the unobstructed extraction region according to the invention, a high-quality filament deposition and a particularly homogeneous nonwoven web can be obtained. Of particular importance within the framework of the combination of the features of the apparatus according to the invention is the closed system or the configuration of the subassembly comprising cooler and stretcher as a closed subassembly.

Primary air means within the framework of the invention the process air guided through the stretcher that emerges from the stretcher or from the stretch passage of the stretcher into the diffusor. A very preferred embodiment of the invention is characterized in that in the area of the secondary air-inlet gaps, the ratio of the volume flows of primary air and secondary air VP/VS is less than 5:1, preferably less than 4.8:1 and preferably less than 4.5:1. According to a recommended embodiment of the invention, the volume flow of the secondary air incoming through the secondary air-inlet gaps is adjustable, preferably for each secondary air-inlet gap and according to one embodiment, adjustable independently of one another. It is recommended that the cross-section of the secondary air-inlet gaps is variable or adjustable.

Advantageously the volume flow of secondary air incoming through two secondary air-inlet gaps provided on opposite ends of the diffusor is the same or substantially the same or differs by a maximum of 15%, in particular by up to a maximum of 20%. Preferably a vertical height of the secondary air-inlet gaps is 2 to 20 mm, preferably 3 to 18 mm and particularly preferably 5 to 15 mm. One embodiment of the invention is characterized in that the volume flow of the secondary air entering through the secondary air-inlet gaps can be adjusted or varied over the CD width (horizontally and transverse to the machine direction MD). Advantageously for this purpose the vertical height of the secondary air-inlet gaps is adjusted or varied over the CD width (transversely to the machine direction MD). It is recommended that the adjustment of the secondary air volume flows is made such that the volume flow of inflowing secondary air decreases relative to the CD direction toward the edges of the apparatus or toward the edges of the secondary air-inlet gaps. Preferably the secondary air volume flow entering through the secondary air-inlet gaps is merely lower in the edge regions of the secondary air-inlet gaps than in the central region of the secondary air-inlet gaps. It is recommended that these edge regions have a length of 5 to 20 cm. In the edge regions advantageously a maximum of 75%, preferably a maximum of 80% of the secondary air volume flow that enters in the central region of the secondary air-inlet gaps is supplied. It is preferred within the scope of the invention that a uniform inflow of secondary air through the secondary air-inlet gaps takes place transversely to the machine direction or in the CD width of the apparatus and according to one embodiment of the invention, apart from the above-mentioned edge regions, advantageously in the entire central region of the secondary air-inlet gaps. In this respect, the invention is based on the discovery that a particularly homogeneous filament deposition can thus be achieved or a very homogeneous filament deposition can be achieved over the CD width.

A very recommended embodiment of the invention is characterized in that in the filament-travel direction a convergent section of the diffusor is immediately downstream or underneath the upstream secondary air-inlet gap. Quite particularly preferred here is an embodiment in which in the filament-travel direction downstream of or underneath the secondary air-inlet gaps, first a convergent section of the diffusor is provided, then a constriction of the diffusor follows and downstream of or underneath the constriction, a divergent section of the diffusor is provided (convergent→constriction→divergent). In the constriction, the secondary air or the primary air-secondary air mixture that has flowed is compressed.

A preferred embodiment is characterized in that the convergent section of the diffusor is shorter than the divergent section of the diffusor. Advantageously the length $\mathbf{1}_k$ of the convergent diffusor section is a maximum of 75%, preferably a maximum of 60% and preferably a maximum of 50% of the length $\mathbf{1}_D$ of the divergent section of this diffusor. It is recommended that the length $\mathbf{1}_k$ of the convergent section of the diffusor is a maximum of 40%, preferably a maximum of 35% and preferably a maximum of 30% of the length $\mathbf{1}_D$ of the divergent diffusor section. Advantageously the ratio $\mathbf{1}_k/\mathbf{1}_D$ of the length $\mathbf{1}_k$ of the convergent diffusor section to the length $\mathbf{1}_D$ of the divergent diffusor section is 0.1:1 to 1:1 and preferably 0.15:1 to 0.9:1. It is recommended that the length $\mathbf{1}_k$ of the convergent diffusor section is 5 to 50% and preferably 10 mm to 50% of the length $L_K+L_D$ of the entire diffusor.

It lies within the scope of the invention that an outlet angle β of the diffusor outlet, or of the furthest downstream diffusor section provided in the filament-travel direction over the depositing device, is a maximum of 30°, preferably a maximum of 25° and very preferably a maximum of 20°. The diffusor outlet angle β is measured between a diffusor wall of the divergent diffusor section and the longitudinal central axis M of the diffusor.

Preferably the diffusor walls of the divergent diffusor section forming the diffusor outlet are pivotable so that the diffusor outlet angle β is variable or adjustable. It is recommended that the width B of the diffusor outlet of the divergent diffusor section in the transverse direction CD is a maximum of 300%, preferably a maximum of 250% and preferably a maximum of 200% of the corresponding width VB of the outlet gap of the stretcher or the stretch passage of the stretcher. A particularly preferred embodiment of the invention is characterized in that the spacing of the diffusor or the lower edge, in particular the lowest lower edge, of the diffusor from the deposition device or from the depositing foraminous belt is 20 mm to 300 mm, in particular 30 mm to 150 mm and preferably 30 mm to 120 mm.

It lies within the scope of the invention that a monomer extractor is provided between the spinneret and the cooler. This monomer extractor pulls air from the filament formation space or passage underneath the spinneret. This way, gases emerging along with the continuous filaments such as monomers, oligomers, decomposition products and the like can be removed from the apparatus according to the invention. The monomer extractor advantageously has at least one extraction chamber to which an extraction fan is connected. The extraction chamber is provided with at least one extraction slot through which the gases are pulled from the filament formation space.

Furthermore a preferred embodiment of the invention contributes to a particularly effective solution of the technical problem characterized in that at least one first deformable seal is provided between the spinneret and the monomer extractor for sealing a first gap formed between the spinneret and the monomer extractor and/or at least one second deformable seal is provided between the monomer extractor and the cooler for sealing a second gap formed between the monomer extractor and the cooler and/or at least one third deformable seal is provided between the cooler and the stretcher or an intermediate passage of the stretcher for sealing a third gap formed between the cooler and the stretcher or the intermediate passage. Preferably the installation properties, in particular the pressing force or the pressing pressure of such a deformable seal are variable or adjustable relative to the boundary regions or boundary surfaces of the respective gap.

It is recommended that such a preferred deformable seal extends over the entire width or over the entire CD width transverse to the machine direction of the apparatus according to the invention. It lies within the scope of the invention that such a deformable seal runs angularly around over the entire circumference or substantially over the entire circumference of the filament flow passage formed by the cooler, stretcher, and diffuser. It lies further within the scope of the invention that the height h of a gap to be sealed with a deformable seal is 3 to 35 mm, in particular 5 mm to 30 mm and that the at least one deformable seal seals over this height h of the gap.

Advantageously, irregularities of the height h of the gap can be compensated for by variation or adjustment of the installation properties of the seal in this height direction. It is recommended that the seal can be filled or is filled with a fluid medium and that adjustment or adjustment of the seal is accomplished by introducing the fluid medium into the seal or by removing the fluid medium from the seal. Preferably the at least one deformable seal is an inflatable seal.

According to another embodiment, the deformable seal can also have at least one sealing element pressed by at least one spring element onto a boundary surface of the gap to be sealed. The sealing element can in particular comprise a seal lip and the seal can thus comprise a spring-loaded seal lip. The sealing element is advantageously fixed on a surface bounding the gap to be sealed and presses the sealing element or the seal lip against the opposite boundary surface of the gap. Preferably the at least one deformable seal is adapted such that a seal is made at a pressure in the filament flow passage of more than 2000 Pa, in particular of more than 2500 Pa. The embodiment with the deformable seal has proved particularly successful within the framework of the teaching according to the invention. Combined with the remaining features according to the invention or preferred features of the apparatus according to the invention, optimal aerodynamic relationships are obtained in the apparatus that effectively contribute to the solution of the technical problem according to the invention.

The invention is based on the discovery that, with the apparatus according to the invention, nonwoven webs or spunbond with exceptional quality can be produced. In particular with the aid of the invention, homogeneous filament deposition and therefore a homogeneous nonwoven web can be produced both in the machine direction and also transversely to the machine direction. An optimal homogeneous nonwoven deposition can be achieved in particular even at higher or at high production speeds. High filament speeds and therefore low titers of the filaments can be achieved with the apparatus according to the invention, with nevertheless good homogeneous filament deposition. High filament speeds and low titers can easily be achieved at high throughputs or production speeds of for example more than 400 m/min.

It should be emphasized that the apparatus according to the invention is nevertheless relatively simple and does not have a complex structure.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
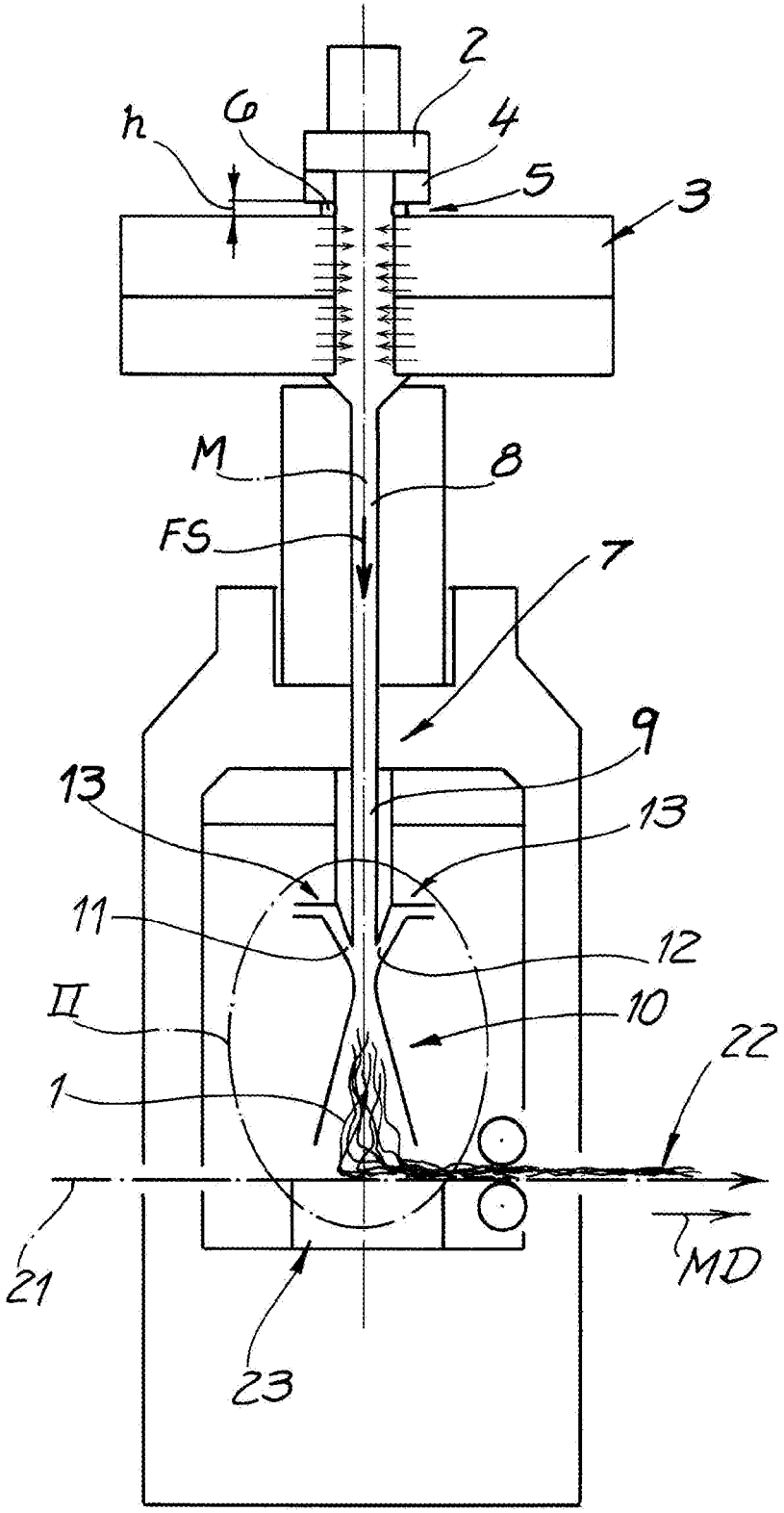
FIG. 1 is a vertical section through an apparatus according to the invention.

The drawing shows an apparatus according to the invention for making spunbond of continuous filaments 1, in particular of continuous thermoplastic. The device has a spinneret 2 for spinning the continuous filaments 1 downward in a filament-travel direction FS as well as a cooler 3 downstream from the spinneret 2 for cooling the spun filaments 1.

According to a particularly preferred embodiment of the invention, a monomer extractor 4 is provided between the spinneret 2 and the cooler 3. With this monomer extractor 4, perturbing gases produced during the spinning process can be removed from the device. These can be, for example, monomers, oligomers or decomposition products and similar substances. A gap 5 is formed between the monomer extractor 4 and the cooler 3 that usually runs around the entire filament formation space or filament flow space. According to a very preferred embodiment and here according to the figures (see in particular FIG. 1), at least one deformable seal 6 for sealing this gap 5 is between the monomer extractor 4 and the cooler 3. Advantageously the seal 6 runs in the gap 5 extends around the entire filament formation space or filament flow space.

Here it lies within the scope of the invention that the installation properties, in particular the pressing force or the pressing pressure of the seal 6 relative to the boundary surfaces of the gap 5 can be varied or adjusted. A vertical height h of the gap 5 here may be 5 to 30 mm and the at least one deformable seal 6 seals the gap 5 over this vertical height h of the gap 5. Preferably and here, the at least one deformable seal 6 has a seal 6 that can be inflated with a fluid medium. By supplying or removing the fluid medium, preferably air, the installation properties, in particular the pressing force or the pressing pressure of the seal 6, can be varied.

Here (see in particular FIG. 1), the cooler 3 has two cooling chambers provided one above the other or consecutively in which the filaments can be acted upon in particular with process air or cooling air at different temperature. In principle however, a cooler 3 with only one cooling chamber is possible within the scope of the invention.

A stretcher 7 for elongating the filaments 1 is provided downstream of the cooler 3 in the filament-travel direction FS. Preferably and here, the cooler 3 opens into an intermediate passage 8 that connects the cooler 3 to a stretch passage 9 of the stretcher 7. According to a preferred embodiment and here, the subassembly comprising the cooler 3, the intermediate passage 8 and the stretch passage 9 is configured as a closed system. Apart from the supply of cooling air in the cooler 3, no further air is supplied to this subassembly 3, 8, 9. The air guided through the stretcher 7 or through the stretch passage 9 is here and subsequently designated as primary air P.

According to the invention, downstream of the stretcher 7 in the filament-travel direction FS there is at least one diffusor 10. Preferably and here, two opposite secondary air-inlet gaps 11 and 12 for the introduction of secondary air S are provided between the stretcher 7 or its stretch passage 9 and the diffusor 10. Advantageously the secondary air-inlet gaps 11 and 12 extend over the entire transverse or CD width of the apparatus according to the invention.

According to the invention the secondary air is supplied through the secondary air-inlet gaps at an inflow angle $\alpha$ that is less than 100°, advantageously less than or equal to 90°, preferably less than 80° and here less than 45°. According to a very recommended embodiment of the invention, the inflow angle $\alpha$ is between 0 and 60°, preferably between 2 and 50°. In order to achieve the inflow angle $\alpha$, here (see in particular FIG. 2) suitable adapted inflow guides 13 are provided that here are configured as inflow passages 14 connected obliquely to the secondary air-inlet gaps 11 and 12. Here the inflow passages 14 form an angle with the filament-travel direction FS or with the longitudinal central axis M such that the secondary air can flow in at the specified inflow angle $\alpha$. According to a particularly preferred embodiment, a quasi-parallel inflow of secondary air to the filament-travel direction FS takes place.

According to a particularly recommended embodiment of the invention, the volume flow of secondary air supplied through the secondary air-inlet gaps 11 and 12 can be adjusted. This can be achieved in particular by adjusting the cross-sections of the secondary air-inlet gaps 11 and 12. In principle, different volume flows of supplied secondary air S can also be adjusted for the two opposite secondary air-inlet gaps 11 and 12. According to one embodiment of the invention, the secondary air volume flow flowing in through the secondary air-inlet gaps 11 and 12, preferably relative to each secondary air-inlet gap 11 and 12, can be adjusted or varied transversely to the machine direction or over the CD width. In this case, the supplied secondary air volume flow in the edge regions or the device or the secondary air-inlet gaps 11 and 12 is advantageously different compared with the central region of the device or the central region of the secondary air-inlet gaps 11 and 12.

As a result of the entrance of secondary air S through the secondary air-inlet gaps 11 and 12, primary air P is mixed with secondary air S in the adjacent diffusor 10. According to a preferred embodiment of the invention, in the region of the secondary air-inlet gaps 11 and 12, the ratio of volume flows of primary air and secondary air VP/VS is less than 5:1 and preferably less than 4.5:1.

Here according to the figures, only one diffusor 10 is provided in the filament-travel direction FS underneath the stretcher 7. In principle two or more diffusors 10 can be connected consecutively. The diffusor 10 provided here according to the figures has a convergent diffusor section 15 downstream of or underneath the secondary air-inlet gaps 11 and 12 in the filament-travel direction FS. Preferably and here, this convergent diffusor section 15 is followed by a constriction 16 of the diffusor 10. In the filament-travel direction FS downstream of or underneath the constriction 16, the diffusor 10 is preferably and here provided with a divergent diffusor section 17. It is here recommended that the divergent diffusor section 17 of the diffusor 10 in the filament-travel direction FS is longer or significantly longer than the convergent diffusor section 15. Preferably and here, the length $\mathbf{1}_k$ of the convergent diffusor section 15 is less than 50% of the length $\mathbf{1}_D$ of the divergent diffusor section 17.

It is here recommended that the diffusor outlet angle $\beta$ between a diffusor wall 18 of the divergent diffusor section 17 and the longitudinal central axis M of the diffusor 14 is a maximum of 25°. Advantageously and here, the width B of the diffusor outlet 19 is a maximum of 300%, preferably a maximum of 250% of the width VB of the outlet gap 20 of the stretch passage 9.

Figure 2:
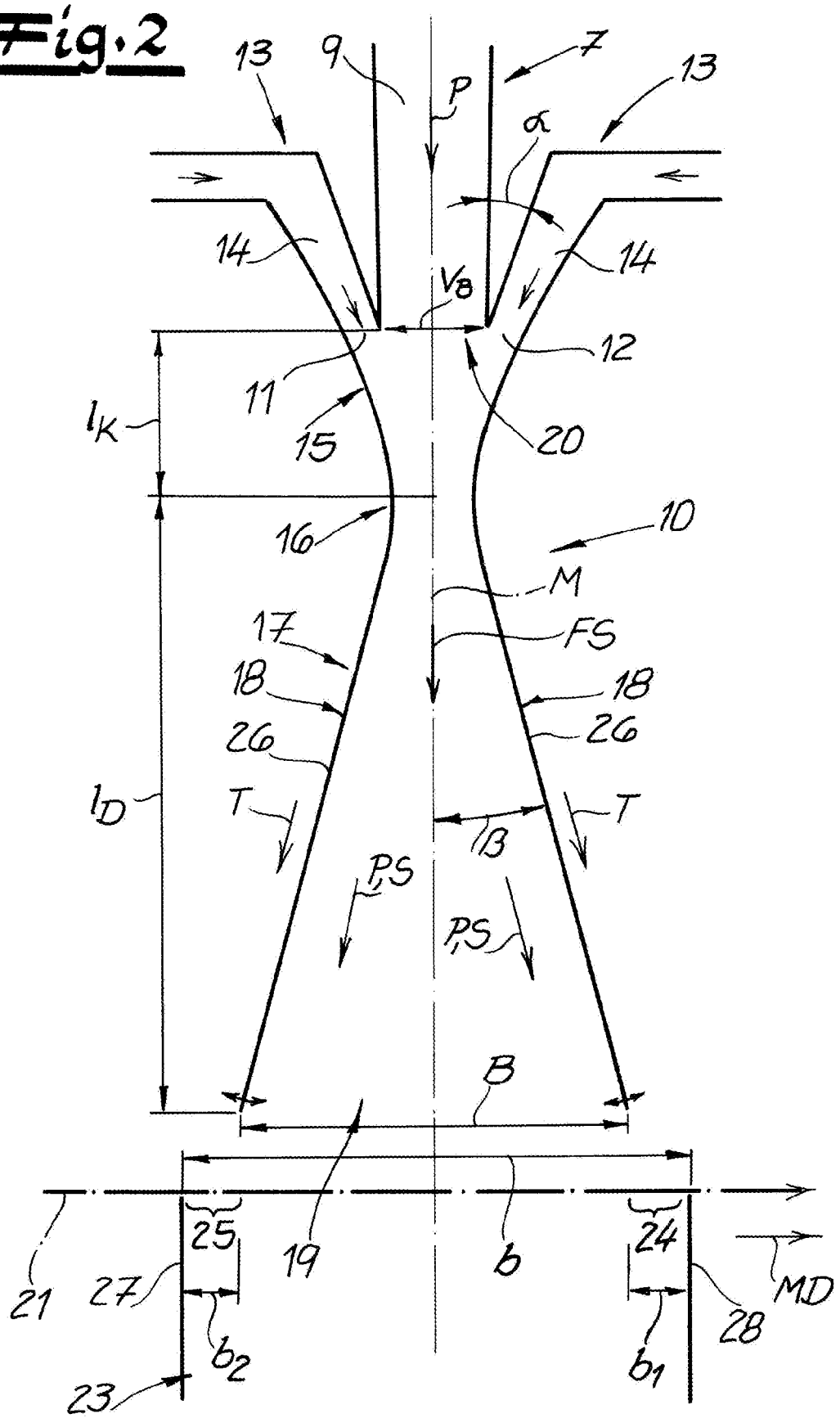
FIG. 2 is an enlarged view of the detail shown at II in the lower region of the apparatus according to the invention.

The continuous filaments 1 emerging from the diffusor 10 are deposited on a deposition device configured as a foraminous belt 21 for filament deposition to form the nonwoven web 22. The deposited filament or nonwoven web 22 is conveyed or transported away by the depositing foraminous belt 21 in the machine direction MD. According to the invention, a suction device for extracting air or process air through the deposition device or through the depositing foraminous belt 12 is provided. To this end, an unobstructed extraction region 23 provided underneath the diffusor outlet 19 that preferably has a width b in the machine direction (MD). This width b of the unobstructed extraction region 23 is according to the invention greater than the width B of the diffusor outlet 19. The widths b and B are shown in FIG. 2. According to a preferred embodiment of the invention, the width b of the unobstructed extraction region 23 is at least 1.2 times, preferably at least 1.3 times the width B of the diffusor outlet 19. Here the width B of the diffusor outlet 19 is measured as the horizontal spacing of the lower edges of the diffusor walls 18. If the edges of the diffusor walls 18 of the divergent diffusor section 17 are at the same horizontal plane or do not end at the same vertical height, the distance of the end of the longer diffusor wall 18 from the end of a downward extension of the shorter diffusor wall 18 is measured.

The unobstructed extraction region 23 located underneath the depositing foraminous belt 21 is delimited by two partitions 27 and 28 provided consecutively in the machine direction MD. The width b of the unobstructed extraction region 23, which is free of further structures between the partitions 27 and 28, is measured as the distance between the two partitions 27 and 28 and specifically as the spacing of the upper edges of the two partitions 27, 28. It can be particularly seen from FIG. 2 that relative to the machine direction MD downstream of the deposition region of the filaments 1 the unobstructed extraction region 23 projects by a first extraction section 24 beyond the diffusor outlet 19 or over the width B of the diffusor outlet 19. Furthermore, relative to the machine direction MD upstream of the deposition region of the filaments 1, the unobstructed extraction region 23 projects by a second extraction section 25 upstream (in direction MD) beyond the diffusor outlet 19 or beyond the width B of the diffusor outlet 19. FIG. 2 shows that the first extraction section 24 has a width $b_1$ and the second extraction section 25 has a width $b_2$. According to one embodiment and here, the widths $b_1$ and $b_2$ are the same. In principle however, they could also be different.

In particular, as a result of the configuration of the unobstructed extraction region 23 according to the invention, the extraction by the depositing foraminous belt 21 takes place such that in the region of the diffusor outlet 19, tertiary air T flows along the outer surfaces 26 toward the foraminous belt 21 being deposited. According to a particularly preferred embodiment, the flows of the tertiary air T are aligned parallel or substantially parallel to the mixed flow of primary air P and secondary air S flowing toward the diffusor outlet 19 of the diffusor 10. Thus, according to a very preferred embodiment of the invention, primary air P and secondary air S as well as tertiary air T are sucked through the depositing foraminous belt 21. Advantageously the flows of primary air P, secondary air S and tertiary air T flow parallel or almost parallel through the depositing foraminous belt 12.

We claim:

1. An apparatus for making spunbond from continuous thermoplastic filaments, the apparatus comprising:

a spinneret for spinning the continuous filaments and advancing them in a filament-travel direction;

a cooler for cooling the filaments;

a stretcher for stretching the filaments;

a depositing device including a foraminous belt extending and traveling in a machine direction transverse to the filament-travel direction and defining a deposition region for deposition of the filaments as a nonwoven web and conveyance away from the stretcher in the machine direction;

a diffusor between the stretcher and the foraminous belt and having relative to the filament-travel direction a downstream section that is of a predetermined length and that diverges in the filament-travel direction, an upstream section that is of a length equal to at most 60% of the predetermined length of the downstream section and that converges in the filament-travel direction, and a constriction between and connecting the sections so that filaments and primary air from the stretcher enter into the diffusor in the filament-travel direction, the diffusor forming relative to the machine direction upstream and downstream secondary air-inlet gaps at opposite ends of the diffusor through which secondary air is aspirated into the diffusor, the upstream and downstream secondary air-inlet gaps being oriented such that the secondary air flows in at an inflow angle $\alpha$ of less than 100° with respect to the filament-travel direction or with respect to a longitudinal central plane of the depositing device or of the diffusor, the downstream section having walls diverging in the filament-travel direction toward the depositing device and forming a diffusor outlet having an outlet width in the machine direction; and a suction device having two partitions spaced apart in the machine direction by an extraction width for extracting air or process air through the foraminous belt at an unobstructed extraction region underneath the diffusor outlet and free of further structures between the partitions, the extraction width in the machine direction being at least 1.5 times the outlet width in the machine direction of the diffusor outlet, the extraction by the suction device taking place such that at least in the region of the diffusor outlet tertiary air flows along outer surfaces of the diffusor walls toward the depositing device or the foraminous belt and the tertiary air flows substantially parallel to a mixed flow of the primary air and the secondary air flowing toward the diffusor outlet inside the diffusor, the tertiary air also being extracted through the foraminous belt by the suction device.

2. The apparatus defined in claim 1, wherein the unobstructed extraction region projects in the machine direction downstream and/or upstream of the deposition region of the filaments by an extraction section beyond the diffusor outlet.

3. The apparatus defined in claim 1, wherein a volume flow of tertiary air extracted with the suction device is at least 25% of a volume flow of the extracted primary and secondary air.

4. The apparatus defined in claim 1, wherein the cooler and the stretcher form a subassembly that is closed such that, apart from a supply of cooling air in the cooler, no further fluid medium or air flows into this closed subassembly.

5. The apparatus defined in claim 1, wherein at the secondary air-inlet gaps, a ratio of volume flows of the primary air to the secondary air is less than 5:1.

6. The apparatus defined in claim 1, wherein a ratio $\mathbf{1}_K/\mathbf{1}_D$ of a length $\mathbf{1}_k$ of the convergent upstream diffusor section to a length $\mathbf{1}_D$ of the divergent downstream diffusor section is 0.1:1.

7. The apparatus defined in claim 1, wherein an outlet angle $\beta$ of the downstream diffusor section with respect to a longitudinal central axis M of the diffusor is a maximum of 30°.

8. The apparatus defined in claim 1, wherein a spacing between the diffusor or a lower edge thereof and the foraminous belt is 20 mm to 300 mm.

* * * * *